US011609072B2

(12) United States Patent
Willson

(10) Patent No.: US 11,609,072 B2
(45) Date of Patent: Mar. 21, 2023

(54) PROJECTILE

(71) Applicant: Jonathan S. Willson, Cecile, OH (US)

(72) Inventor: Jonathan S. Willson, Cecile, OH (US)

( * ) Notice: Subject to any disclaimer, the term of this patent is extended or adjusted under 35 U.S.C. 154(b) by 0 days.

(21) Appl. No.: 17/397,170

(22) Filed: Aug. 9, 2021

(65) Prior Publication Data

US 2023/0043976 A1 Feb. 9, 2023

(51) Int. Cl.

| | |
|---|---|
| ***F42B 12/46*** | (2006.01) |
| ***F42B 10/22*** | (2006.01) |
| ***F42B 12/40*** | (2006.01) |

(52) U.S. Cl.

CPC ..... *F42B 12/46* (2013.01); *F42B 10/22* (2013.01); *F42B 12/40* (2013.01)

(58) Field of Classification Search

CPC ..... F42B 12/46; F42B 12/40; F42B 10/22

USPC ..... 102/502

See application file for complete search history.

(56) References Cited

U.S. PATENT DOCUMENTS

| | | | | |
|---|---|---|---|---|
| 6,393,992 | B1 * | 5/2002 | Vasel | F41B 15/02 102/370 |
| 6,772,694 | B1 * | 8/2004 | Pearce, III | F42B 12/50 102/370 |
| 7,021,219 | B1 * | 4/2006 | Dindl | F42B 5/045 102/470 |
| 9,157,715 | B1 * | 10/2015 | Lafortune | F42B 12/76 |
| 11,175,118 | B1 * | 11/2021 | Manley | F42B 12/62 |
| 2003/0047105 | A1 * | 3/2003 | Vasel | F41B 11/57 102/502 |
| 2005/0066841 | A1 * | 3/2005 | Vasel | F42B 12/40 102/502 |
| 2005/0188886 | A1 * | 9/2005 | Vasel | F41B 11/57 102/502 |
| 2011/0079164 | A1 * | 4/2011 | Broden | F42B 8/16 102/444 |

FOREIGN PATENT DOCUMENTS

| | | | | |
|---|---|---|---|---|
| WO | WO-2018005196 | A1 * | 1/2018 | F42B 12/24 |

* cited by examiner

*Primary Examiner* — Samir Abdosh
(74) *Attorney, Agent, or Firm* — Taylor IP, P.C.

(57) ABSTRACT

A projectile including a first section and a second section. The first section and the second section being snapped together at a snap together interface having a pressure angle of at least 75 degrees. The first section and the second section forming at least one cavity therebetween, with a payload contained in the cavity.

19 Claims, 4 Drawing Sheets

PROJECTILE

BACKGROUND OF THE INVENTION

1. Field of the Invention

The present invention relates to projectiles, and, more particularly, to frangible projectiles containing a deliverable payload.

2. Description of the Related Art

A projectile can be considered any object propelled with force, generally in a manner aimed at a target. It is known that projectiles can be solid or have cavities therein carrying irritants, incapacitants or the like.

Projectiles are accelerated by some mechanism that imparts motion to the projectile. A common method is the use of a gas force in a barrel that pushes the projectile through the barrel. The gas can be an expanding gas from an ignited propellant that burns rapidly behind the projectile causing a high pressure to propel the projectile. Another method is to use a released gas from a pressurized storage to push the projectile.

The manufacturing of projectiles is often done in a controlled environment so that tolerances and materials are controlled for predictable results. This includes the loading of the projectile with a payload, which is generally not possible without the use of tools and fixtures.

What is needed in the art is an easy to assemble projectile that can carry a payload therein.

SUMMARY OF THE INVENTION

The present invention provides a frangible projectile that contains a compound agent.

The invention in one form is directed to a projectile including a first section and a second section. The first section and the second section being snapped together at a snap together interface having a pressure angle of at least 75 degrees. The first section and the second section forming at least one cavity therebetween, with a payload contained in the cavity.

An advantage of the present invention is that the projectile can be assembled without the use of tools.

Another advantage is that fracture characteristics of the shell of the projectile can be used to direct the agent contained in the projectile.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
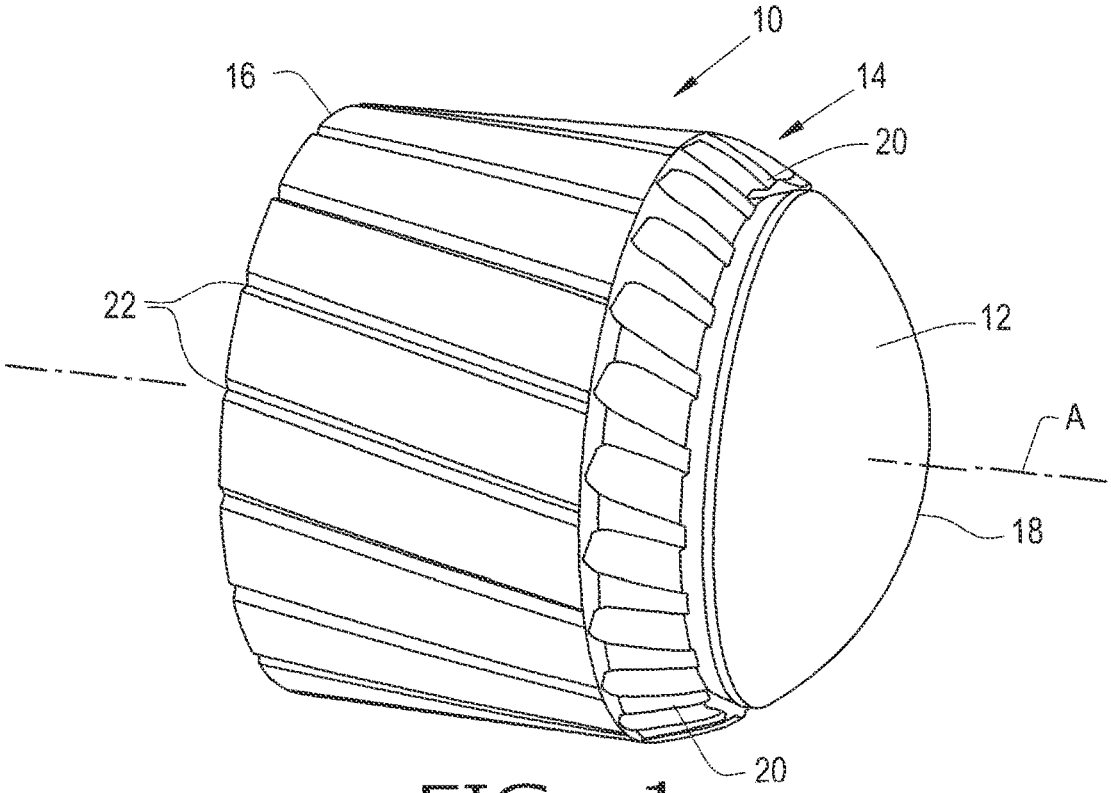
FIG. 1 is a perspective view of an embodiment of a frangible projectile according to the present invention.

Referring now to the drawings, and more particularly to FIG. 1, there is shown a perspective view of a projectile 10, that is symmetrically formed about a longitudinal axis A. Projectile 10 is fired from a device, which may have a barrel that contains an expanding or exploding gas as it propels projectile 10 therefrom.

Projectile 10 has a forward section 12, a mid-section 14 and a rear section 16. Forward section 12 has an aerodynamic nose 18 since as it moves it encounters air that provides some resistance. Mid-section 14 has aerodynamic fins 20 that provide a spin to projectile 10 as it moves through the air. Mid-section 14 is coupled to both forward section 12 and rear section 16. Rear section 16 includes grooves 22, which provide for the fracturing of rear section 16. It is also contemplated that grooves 22 may be interior to rear section 16. Grooves 22 are formed so that they will add to the spin stability of projectile 10, or at least not interfere with the spin provided by fins 20.

Figure 2:
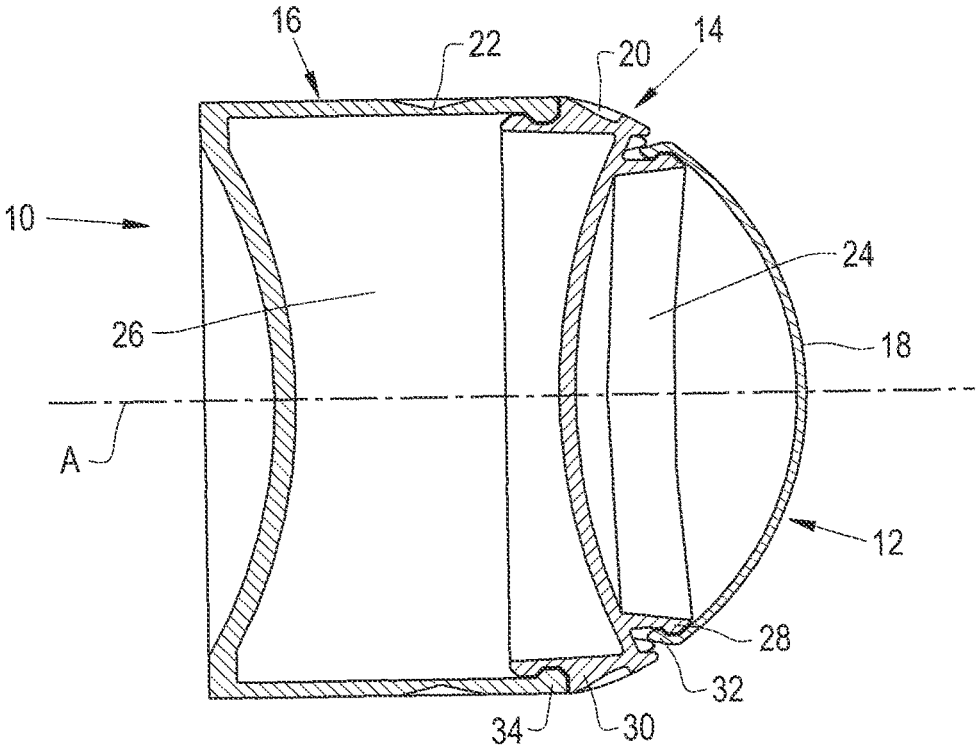
FIG. 2 is a cross sectional view of the frangible projectile shown in FIG. 1.

Now, additionally referring to FIG. 2, there is shown a cross-sectional view of projectile 10 with cavities 24 and 26 being formed respectively in sections 12 and 16 with mid-section 14 being a boundary therebetween. Mid-section 14 has two snap-together interfaces 28 and 30, which respectively snap with reciprocal interfaces 32 and 34. Cavity 24 is a compartment that contains a high density ballast material that maintains the momentum of projectile 10 as it moves toward a target. Cavity 26 is a compartment that is used contain a relatively light weight payload material, the payload may be in the form of an irritant powder.

The lightweight active powder is carried separately (in cavity 26) from the ballast material (in cavity 24) so when the powder in cavity 26 is released it has a much higher efficacy as it is not mixed with the heavy powder of cavity 24 for stability purposes.

Upon impact of projectile 10, rear portion 16 of projectile 10 collapses pressurizing the air in the powder area of cavity 26 and makes the powder disperse very well with the high exiting air velocity as rear section 16 ruptures along grooves 22.

The spin stabilizing fins 20 are toward the front of projectile 10—which doesn't change the stability of projectile 10 with the location of the ballast up front.

Advantageously, as projectile 10 is being assembled the separate material added to cavities 24 and 26 are sealed by the snapping interaction of interfaces 28 and 32; and 30 and 34. This feature allows for quick tool-less assembly if done by hand, or by an efficient automated method.

Now, additionally referring to FIGS. 3-7, there are illustrated other embodiments of the present invention.

Figure 3:
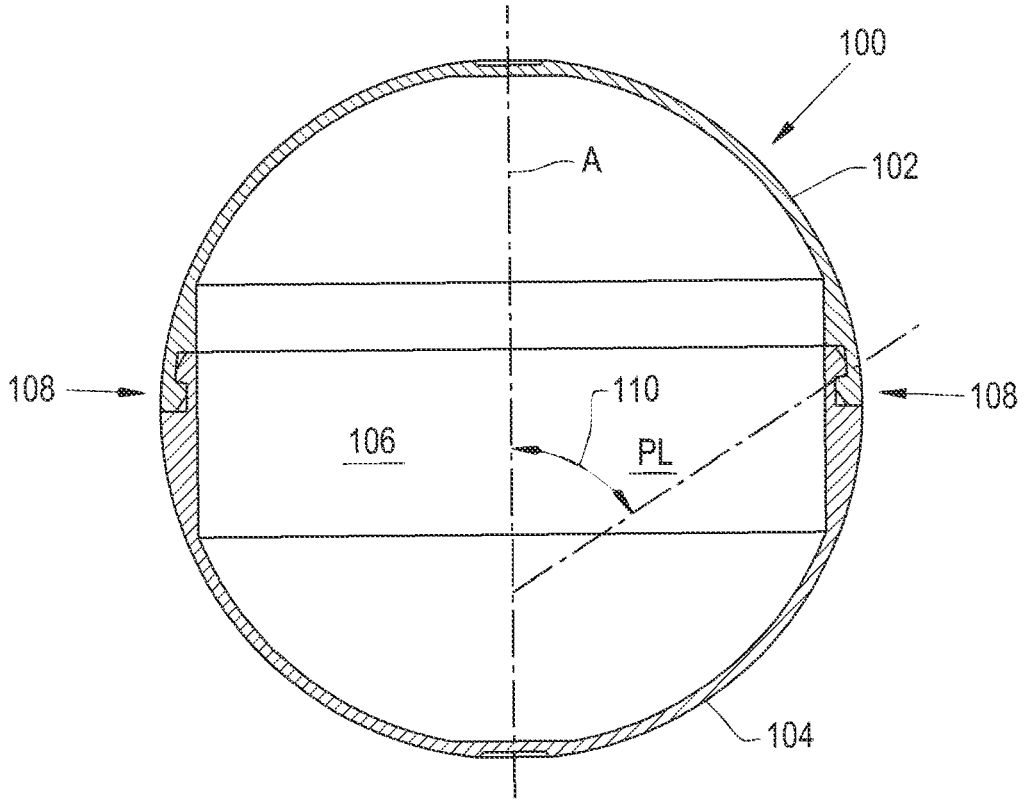
FIG. 3 is a cross sectional view of another embodiment of a frangible projectile of the present invention.

FIG. 3 illustrates a cross sectional view of a projectile 100, that is symmetrically formed about axis A. Projectile 100 is fired from a device, which may have a barrel that contains an expanding or exploding gas as it propels projectile 100 therefrom. Projectile 100 is substantially spherical in shape, as can be seen in FIG. 3.

Projectile 100 has a first section 102 and a second section 104 that together form a cavity 106, which is a compartment 106 that, when filled, contains a payload PL that can be in the form of a high-density ballast material PL. The ballast material PL maintains the momentum of projectile 100 as it moves toward a target. Sections 102 and 104 are of similar size and shape.

Sections 102 and 104 have a snap together interface 108 with a pressure angle 110 from 45 to 110 degrees, or more preferably 60 to 110 degrees, or even more preferably 70 to 100 degrees, or yet still more preferably 75 to 100 degrees or approximately 75 degrees. Snap together interface 108 have reciprocal features including pressure angle 110 that ensure that sections 102 and 104 remain connected together. The resiliency of the material used in making sections 102 and 104 also contributes to the secure connection of interface 108. The high angle 110 ensures that the interface is inseparable once snapped together. Advantageously, as projectile 100 is being assembled, cavity 106 is sealed by the snapping interaction of interface 108. This feature allows for quick tool-less assembly if done by hand, or by an efficient automated method.

Figure 4:
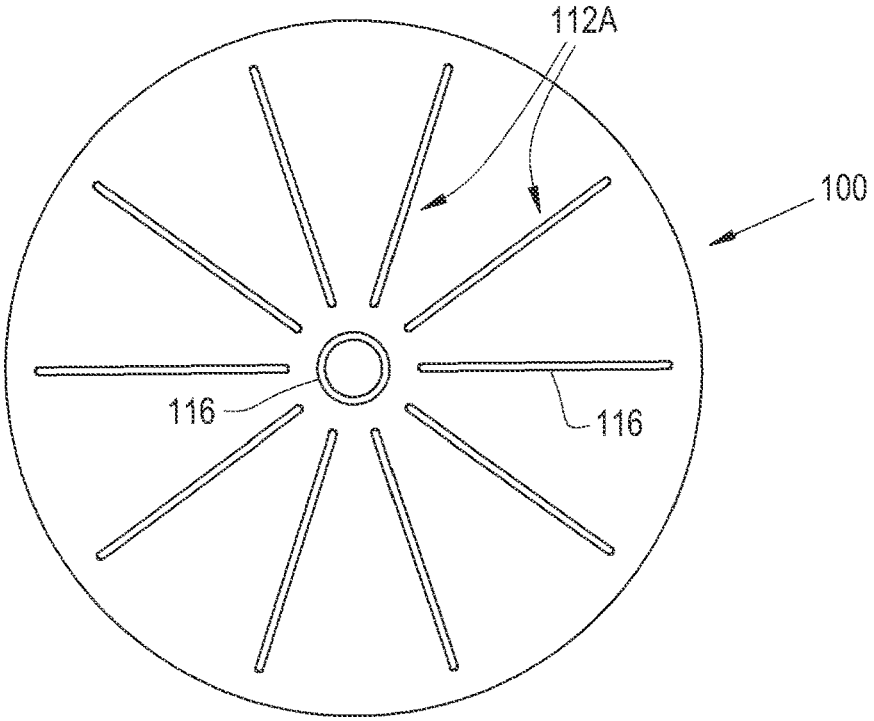
FIG. 4 is a front view of the frangible projectile of FIG. 3.
Figure 5:
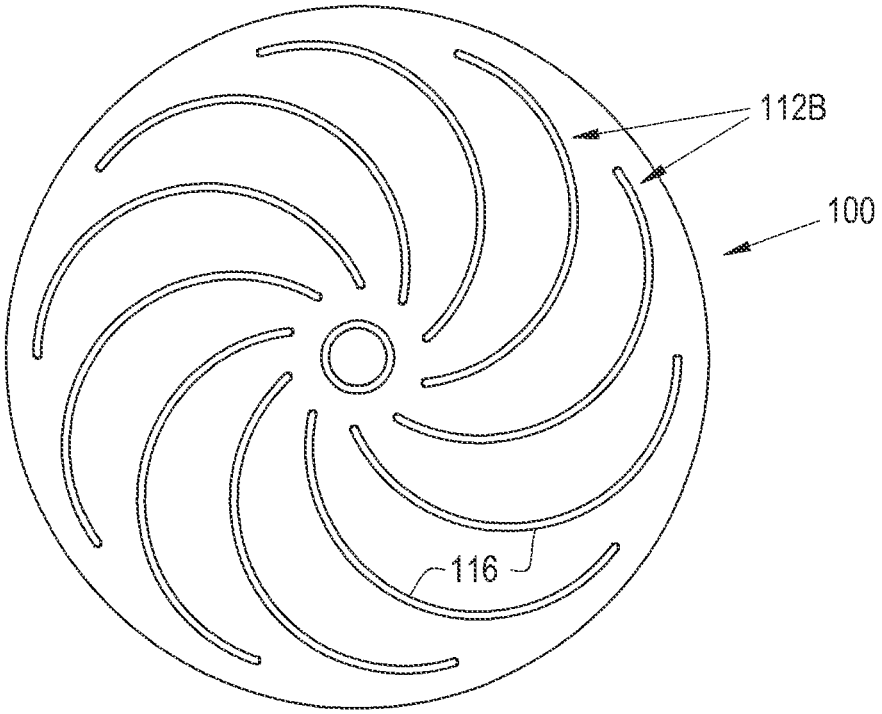
FIG. 5 is a front view of another embodiment of a frangible projectile of the present invention.
Figure 6:
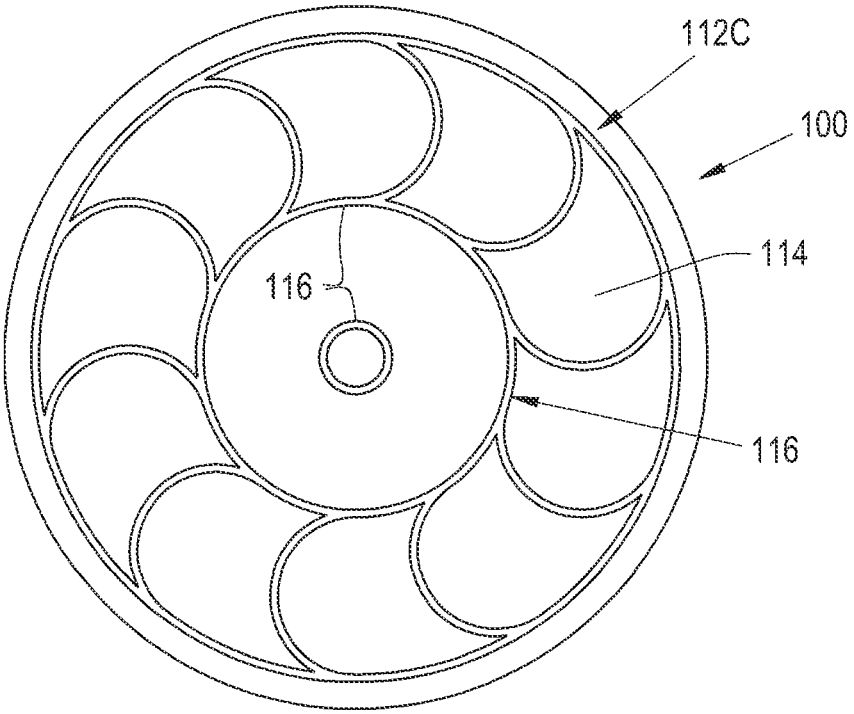
FIG. 6 is a front view of yet another embodiment of a frangible projectile of the present invention.

FIGS. 4-6 are exterior views that illustrate ablative crack initiation patterns 112A-C. Upon impact of projectile 100 the crack initiation sites 112A-C allow the walls of section 104 to break earlier and more consistently, thereby releasing the payload in cavity 106 and lowering the impact pressure on the target. The use of ablation to form patters 112A-C allows projectile 100 to be manufactured at full wall strength and then later have the fracture characteristics lowered below what would have caused fracture during the assembly process. The ablations to form patterns 112A-C are more generally material voids 116 that are made in an inner or outer surface of section 102 or even 104, material voids 116, which are also grooves 116, weaken section 102 along grooves 116. Many patterns made of grooves 116 may be used with engineered fracture mechanics depending on the end use, for example, a spoke pattern 112A, a spiral pattern 112B, or a combination radial and spiral 112C. Pattern 112C shows intersecting grooves 116 that allow areas 114 to separately fracture from section 102 and remain individually intact when projectile 100 impacts a target. While symmetrical patterns 112A-C about axis A are illustrated, it is also contemplated that asymmetrical patterns may also be utilized.

Figure 7:
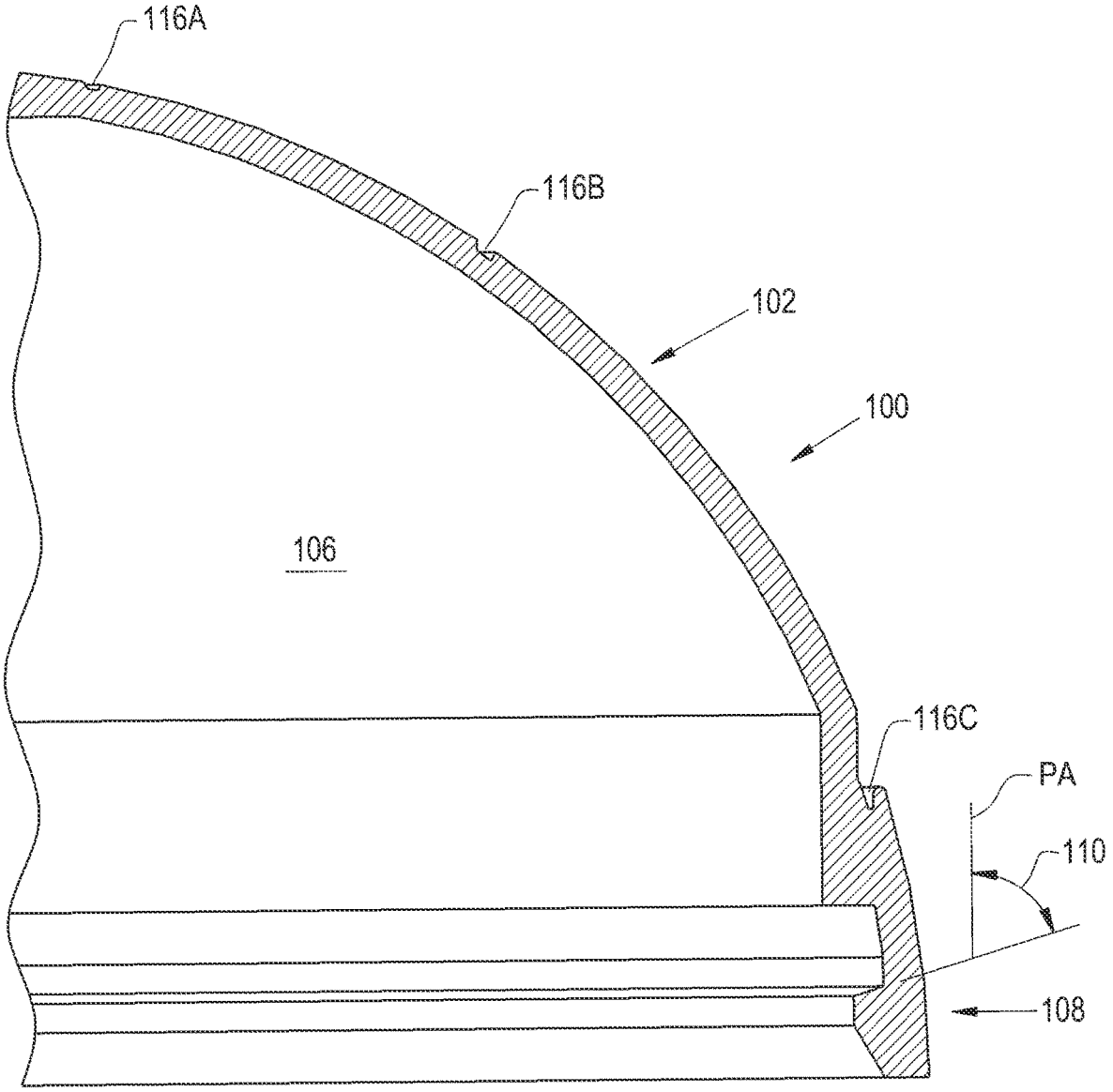
FIG. 7 is a side cross sectional view illustrating details of the projectile that are typical with the foregoing embodiments of the present invention.

In FIG. 6 pattern 112C allows preferential fracture control preventing fracture in area 114 while initiating it readily along material void areas 116, which are in the form of grooves 116. if payload PL is a powder, this would allow the powder to escape at higher velocity resulting in a more effective distribution of powder payload to the target. In FIG. 7 different groove depths 116A, 116B, and 116C are shown to further tailor the fracture characteristics of projectile 100. The characteristics discussed relative to projectile 100 are also applicable to projectile 10. In FIG. 7 a line that is parallel to axis A is denoted as parallel axis PA to illustrate pressure angle 110 that can be from 75-110 degrees, which serves to ensure the connection between sections 102 and 104.

Concerning payload PL it adds mass to projectile 10, 100, and can have an active agent therein, such as a marker, a skin/eye irritant, an inoculating element, etc. in the form of a powder, a liquid, or a gel. It is also contemplated that the agent may have some reactive characteristic when released at/on the target. In the case of projectile 10 having two cavities the ballast and agent can be separated with one in each cavity. It is also contemplated that elements in the two cavities of projectile 10 may be combined upon impact and have a reactive nature due to the mixing of the two payloads. The sections of projectiles 10 and 100 are assembled by snapping the sections together in a manner in which tools are not required, thereby allowing a hand assembly. Alternatively, tooling can be used to rapidly assemble the sections by pressing them together with snap features 108 securing the sections together.

It is also contemplated that ablative crack initiation patterns 112A-C can alternately, or additionally be placed on the inner surface of section 104, and/or section 102. Patterns can be ablated so that an inner and outer pattern correspond or contrast with each other to thereby control the fracture of projectile 100 or 10.

It is also contemplated that sections 102 or 104 may have strengthening material applied to the inner or outer surface to also alter the fracturing characteristics of projectile 100 or 10.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A projectile, comprising:

a first section;

a second section, the first section and the second section being snapped together at a snap together interface having a pressure angle of at least 75 degrees, the first section and the second section forming at least one cavity therebetween; and a payload in the cavity, wherein the payload has a ballast portion to provide mass to the projectile.

2. The projectile of claim 1, wherein the first section and/or the second section have material voids in an inner or outer surface thereof, the material voids weakening the section having the material voids.

3. The projectile of claim 2, wherein the material voids are grooves.

4. The projectile of claim 3, wherein the grooves are symmetrically arranged on an outer surface of one of the sections.

5. The projectile of claim 4, wherein the grooves are symmetrical about an axis of the projectile.

6. The projectile of claim 3, wherein at least one groove intersects an other groove.

7. The projectile of claim 3, wherein some grooves are deeper than other grooves.

8. The projectile of claim 1, wherein the pressure angle is between 75 and 110 degrees.

9. The projectile of claim 1, wherein the payload additionally has an active agent portion.

10. The projectile of claim 1, wherein the first section and the second section are snapped together without the use of tools.

11. The projectile of claim 1, wherein the first section and the second section are approximately a same size.

12. The projectile of claim 1, wherein the projectile is substantially spherical in shape.

13. The projectile of claim 1, further comprising a third section that snaps to the second section.

14. The projectile of claim 13, wherein an other cavity is formed between the second and third sections.

15. A projectile, comprising:

a first section;

a second section, the first section and the second section being snapped together at a snap together interface having a pressure angle of at least 75 degrees, the first section and the second section forming at least one cavity therebetween; and a payload in the cavity;

a third section that snaps to the second section; and an other cavity is formed between the second and third sections, wherein an other payload is contained in the other cavity.

16. The projectile of claim 15, wherein the third section has a series of angled grooves therearound to impart a spin to the projectile as it moves through the air.

17. The projectile of claim 15, wherein either the payload or the other payload is primarily a ballast material.

18. The projectile of claim 15, wherein the payload in the cavity is an active agent.

19. The projectile of claim 18, wherein the first section has material voids in a surface thereof, the material voids weakening the first section so that it will fracture in areas where the material voids are present thereby dispersing the active agent when the projectile impacts a target.

* * * * *